US005181858A

United States Patent [19]

Matz et al.

[11] Patent Number: 5,181,858

[45] Date of Patent: Jan. 26, 1993

[54] CABLE TYPE IDENTIFYING AND IMPEDANCE MATCHING ARRANGEMENT

[75] Inventors: Bret A. Matz, Harrisburg, Pa.; K. C. Babu, Kerala; Hemant Kumar, K. R., Bangalore, both of India

[73] Assignee: AMP Incorporated, Harrisburg, Pa.

[21] Appl. No.: 752,728

[22] Filed: Aug. 30, 1991

[51] Int. Cl.[5] ..... H01R 13/703

[52] U.S. Cl. ..... 439/188; 439/489; 439/638

[58] Field of Search ..... 439/188, 489, 490, 488, 439/189, 516, 638; 324/66; 307/116, 125, 140

[56] References Cited

U.S. PATENT DOCUMENTS

| | | | |
|---|---|---|---|
| 3,191,095 | 6/1965 | Hefti | 439/188 |
| 4,675,769 | 6/1987 | Marshall et al. | 307/140 |
| 4,726,775 | 2/1988 | Owen | 439/49 |
| 4,829,244 | 5/1989 | Tom et al. | 324/158 F |
| 4,915,639 | 4/1990 | Cohn et al. | 439/188 |
| 4,950,169 | 8/1990 | Martin et al. | 439/44 |
| 5,095,277 | 3/1992 | Cerda | 324/66 |

*Primary Examiner*—Neil Abrams

[57] ABSTRACT

An arrangement in a token ring line concentrator for providing appropriate connections to a cable includes a connector adaptor (30, 60) having a printed circuit board (34, 64) on which selected contact members (36, 38; 66, 68) are left either unconnected or shorted together to identify the particular type of adaptor, thus identifying the particular type of cable plugged into the adaptor. The port to which the adapter is inserted includes switchable connections controlled by the selective energization of a relay coil (138). The coil (138) is energized when an open connection between the selected contact members is identified.

4 Claims, 2 Drawing Sheets

CABLE TYPE IDENTIFYING AND IMPEDANCE MATCHING ARRANGEMENT

BACKGROUND OF THE INVENTION

This invention relates to cable connecting apparatus and, more particularly, to such apparatus which can identify the type of cable connected thereto so as to make appropriate electrical connections to the wires within the cable.

In ring communications networks, such as, for example, those conforming to the IEEE Standard 802.5-1989 covering token ring networks, a plurality of line concentrators are connected together in a closed loop (i.e., a ring) by means of a trunk cable. Each concentrator includes a plurality of station ports to which a terminal, such as a computer, may be connected for communication over the ring with other such terminals in the network. Each concentrator also has a ring-in port and a ring-out port for interfacing with the medium (trunk cable) connected between the concentrators.

The trunk cable connecting the concentrators, as well as the station cable connecting the terminals to the station ports, typically includes four wires. Each of these wires must be connected in a defined manner to the terminals and the ports. While the wires within the cable have a fixed number as well as a fixed positional relationship, the cable itself can be selected from a number of different types. Thus, for example, the cable can be of the unshielded twisted pair type or the shielded twisted pair type. These different types of cable can have different electrical characteristics. For example, unshielded twisted pair cable has a characteristic impedance of one hundred ohms, whereas shielded twisted pair cable has a characteristic impedance of one hundred fifty ohms. It would be desirable to allow the equipment user to have the discretion to select the type of cable to be used in a particular installation. It would also be desirable to allow the user to be able to mix the types of cable within an installation, and even within a concentrator. It is therefore an object of the present invention to provide an arrangement for identifying the type of cable installed in a port.

It is a further object of this invention to provide an arrangement which, upon identifying the type of cable, provides suitable connections for that type of cable.

SUMMARY OF THE INVENTION

The foregoing, and additional, objects are attained in accordance with the principles of this invention by providing cable connector apparatus which comprises a first group of contact members and a second group of contact members. The individual wires within a cable are connected each to a respective one of the contact members of the first group and identifying means provides connections between contact members of the second group in a pattern which can be used to identify the type of cable which is connected to the contact members of the first group.

In accordance with an aspect of this invention, there is also provided an arrangement in the cable receptacle for detecting the connections between the second group of contact members so as to identify the type of cable and utilizing that identification to provide appropriate connections to the first group of contact members.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

The illustrative embodiment described herein relates to a ring communications network operating in accordance with the IEEE Standard 802.5-1989 covering token ring networks. However, it is understood that the present invention may be utilized in other environments as well, provided suitable modifications are made.

In a token ring network, a plurality of line concentrators are connected together in a closed loop (i.e., a ring) by trunk cable segments connecting adjacent concentrators in the ring. Each concentrator includes a plurality of station ports to each of which a terminal, such as a computer, may be connected for communication over the ring with other such terminals in the network. Each terminal is connected to its respective station port by a station cable segment. Each concentrator also has a ring-in port and a ring-out port for interfacing with the trunk cable segments connected between that concentrator and the next adjacent concentrators in the ring. In the case of a token ring network, each cable segment has four wires and is terminated by a plug. Two types of cable may be utilized. The first type is shielded twisted pair cable and the second type is unshielded twisted pair cable. The shielded twisted pair cable has a characteristic impedance of one hundred fifty ohms and the unshielded twisted pair cable has a characteristic impedance of one hundred ohms. Each of the types of cable is terminated by its own characteristic plug.

Figure 1:
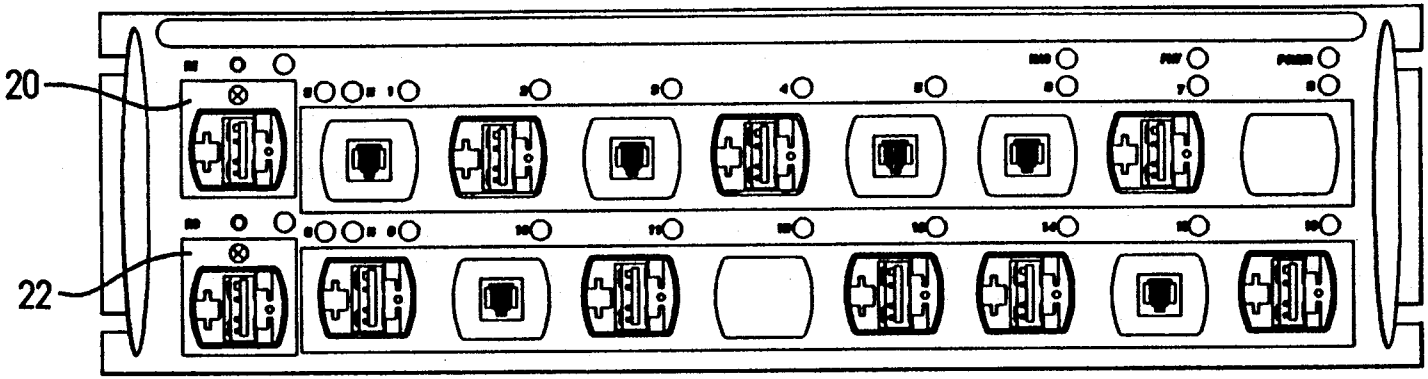
FIG. 1 is a front view of a panel for a token ring concentrator in which the principles of this invention may be applied.

It would be desirable to allow the user of the network to be able to choose, at will, the type of cable segment to be used for connection to the concentrator. FIG. 1 illustrates the front panel of a sixteen station concentrator constructed in accordance with the principles of this invention. As shown in FIG. 1, each of the eighteen port positions of the concentrator (sixteen station ports, one ring-in port and one ring-out port) is either blank or contains an adaptor connector for either the shielded twisted pair cable or the unshielded twisted pair cable. Thus, as shown in FIG. 1, the ring-in port position 20 and the ring-out port position 22 both are fitted with shielded twisted pair cable adaptors; the station port positions 1, 3, 5, 6, 10, and 15 are all fitted with unshielded twisted pair cable adaptors; the station port positions 2, 4, 7, 9, 11, 13, 14, and 16 are all fitted with shielded twisted pair cable adaptors; and the station port positions 8 and 12 are blank.

Figure 2B:
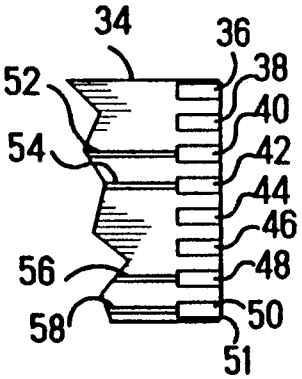
FIG. 2B is a plan view showing the contact members of the adaptor of FIG. 2A.
Figure 2A:
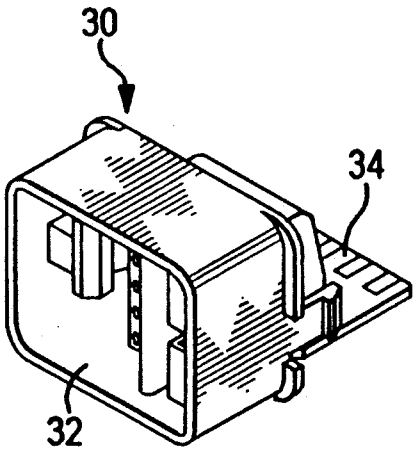
FIG. 2A is a perspective view of a cable connector adaptor according to this invention for a first type of cable.

In accordance with this invention, each of the ports includes circuitry for detecting the type of cable connected to that port and providing appropriate electrical connections for that type of cable. In the illustrative embodiment, the cable is terminated with the appropriate characteristic impedance for that type of cable. FIG. 2A illustrates an adaptor connector 30 for a shielded twisted pair cable. When the user of the concentrator desires that a station is to be connected to a particular station port by a shielded twisted pair station cable segment, an adaptor such as that shown in FIG. 2A is installed at that port position in the concentrator. The adapter 30 includes a socket portion 32 which conforms to the specifications for receiving the type of plug utilized with shielded twisted pair cable. The socket portion 32 is mounted on a printed circuit board 34. As shown in FIG. 2B, the printed circuit board 34 has a plurality of printed circuit fingers, or contact members, 36, 38, 40, 42, 44, 46, 48 and 50 extending from a forward edge 51 thereof. The contact members 36-50 are divided into two groups. The first group includes the contact members 40, 42, 48 and 50 which are electrically connected, via the traces 52, 54, 56 and 58, respectively, to the socket portion 32. Within the socket portion 32, the contact members of the first group are connected to respective contact members of the socket portion which mate with corresponding contact members of the cable plug, in a conventional manner. The second group of contact members includes the contact members 36, 38, 44 and 46, which remain unconnected.

Figure 3B:
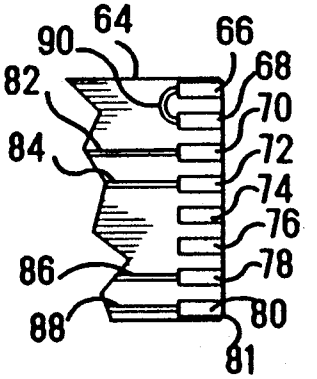
FIG. 3B is a plan view showing the contact members of the adaptor of FIG. 3A.
Figure 3A:
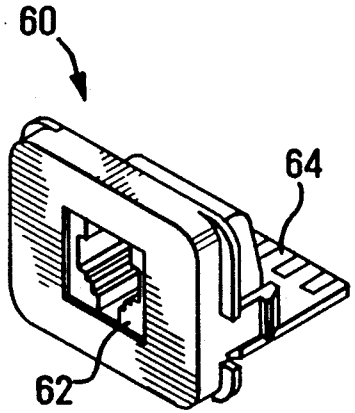
FIG. 3A is a perspective view of a cable connector adaptor according to this invention for a second type of cable.

FIG. 3A illustrates the adaptor connector 60 which is utilized for unshielded twisted pair cable. The adapter 60 includes a socket portion 62 and a printed circuit board 64. The socket portion 62 is arranged to accept therein a conventional modular plug utilized with four wire unshielded twisted pair cable. As shown in FIG. 3B, the circuit board 64 includes printed circuit fingers, or contact members, 66, 68, 70, 72, 74, 76, 78 and 80 extending from the forward edge 81 of board 64. These contact members are likewise divided into two groups. The first group includes the contact members 70, 72, 78 and 80, which are electrically connected, via the traces 82, 84, 86, 88, respectively, to the socket portion 62. Within the socket portion 62, the contact members of the first group are connected to contact members of the socket portion which mate with corresponding contact members of the cable plug, in a conventional manner. The second group of contact members includes the contact members 66, 68, 74 and 76. Illustratively, the contact members 66 and 68 are connected together via the trace 90 so that, in accordance with this invention, the adaptor connector 60, and the cable connected thereto, may be identified as being of the unshielded twisted pair type.

Figure 4:
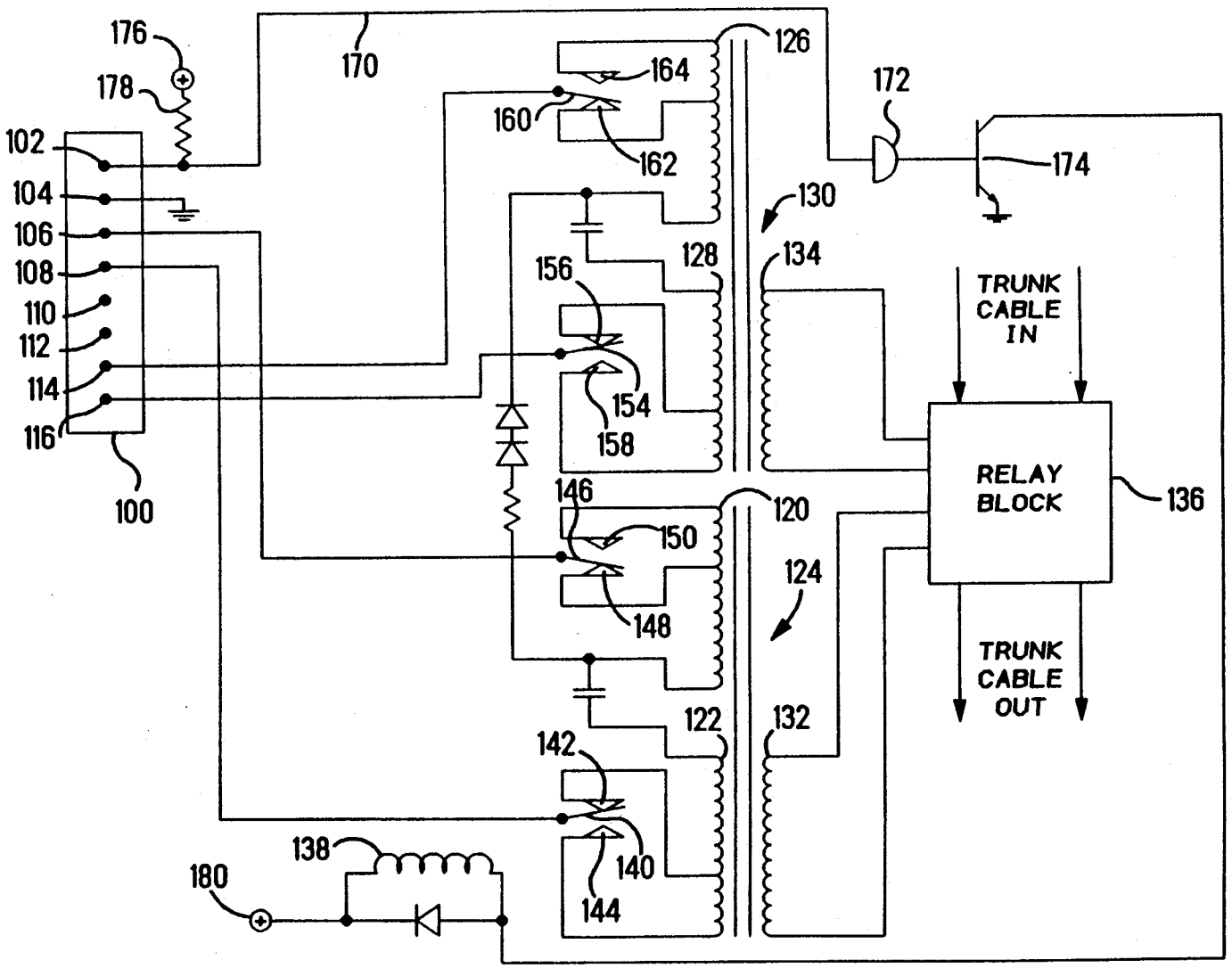
FIG. 4 is a schematic diagram of circuitry constructed according to this invention for identifying the type of cable and providing appropriate connections thereto.

FIG. 4 illustrates circuitry in a concentrator port which recognizes the particular type of cable connected to that port and terminates that cable with the appropriate characteristic impedance. Each port includes a receptacle 100 for receiving either the printed circuit board 34 of the adaptor connector 30 or the printed circuit board 64 of the adaptor connector 60. The receptacle 100 includes terminals 102, 104, 106, 108, 110, 112, 114 and 116 which provide electrical connections to respective contact members of the printed circuit boards. Thus, the terminal 102 is associated with the contact members 36, 66; the terminal 104 is associated with the contact members 38, 68; the terminal 106 is associated with the contact members 40, 70; the terminal 108 is associated with the contact members 42, 72; the terminal 110 is associated with the contact members 44, 74; the terminal 112 is associated with the contact members 46, 76; the terminal 114 is associated with the contact members 48, 78; and the terminal 116 is associated with the contact members 50, 80. Accordingly, since none of the contact members 44, 46, 74 or 76 has a connection, the terminals 110 and 112 are similarly unconnected.

As is conventional, the cable wires connected to the terminals 106 and 108 are coupled to the windings 120 and 122 of the isolation transformer 124 and the cable wires connected to the terminals 114 and 116 are coupled to the windings 126 and 128 of the isolation transformer 130. The winding 132 of the transformer 124 and the winding 134 of the transformer 130 are connected to the relay block 136 which is controlled in accordance with the IEEE Standard 802.5-1989 to selectively couple the station at that port position into the ring or isolate the station from the ring.

In accordance with this invention, there is provided a relay having a coil 138, a moveable armature 140 associated with contacts 142 and 144, a moveable armature 146 associated with contacts 148 and 150, a moveable armature 154 associated with contacts 156 and 158, and a moveable armature 160 associated with contacts 162 and 164. Thus, the contacts 144, 150, 158 and 164 are each connected to a first end of respective transformer windings 122, 120, 128 and 126. The contacts 142, 148, 156 and 162 are each connected to intermediate taps of respective transformer windings 122, 120, 128 and 126. The moveable armature 140 is connected to the terminal 108. The moveable armature 146 is connected to the terminal 106. The moveable armature 154 is connected to the terminal 116. The moveable armature 160 is connected to the terminal 114. As shown in FIG. 4, when the coil 138 is not energized, the armatures 140, 146, 154 and 160 are in the illustrated positions so that the cable coupled to the receptacle 100 is connected to the intermediate taps of the transformer windings 122, 120, 128 and 126, thereby providing, illustratively, a one hundred ohm termination for the cable. This is appropriate when the cable is of the unshielded twisted pair type. However, when the cable is of the shielded twisted pair type, it is desired to energize the coil 138 so that the armatures 140, 146, 154 and 160 make contact with the respective contacts 144, 150, 158 and 164 to connect the cable wires to the ends of the transformer windings 122, 120, 128 and 126 to provide a one hundred fifty ohm termination.

Energization of the relay coil 138 is effected in accordance with the principles of this invention when the adaptor connector 30 is installed, but not when the adaptor connector 60 is installed. Thus, when the adaptor connector 60 is installed in the receptacle 100, since the contact members 66 and 68 are connected together via the trace 90, the terminals 102 and 104 of the receptacle 100 are connected together. This provides a low signal on the lead 170 to the gate 172, which keeps the transistor 174 out of conduction, thus not providing a path for the energization of the coil 138. Conversely, when the adaptor connector 30 is installed in the receptacle 100, there is no connection between the terminals 102 and 104. Accordingly, the lead 170 is at a high voltage, as provided by the source 176 through the resistor 178. This high signal on the lead 170 passes through the gate 172 to force the transistor 174 into its conductive state, providing an energization path for the relay coil 138 from the supply 180.

Although the illustrative embodiment disclosed herein identifies two cable types, it is understood that by using additional contact members of the second group, such as contact members 44, 46, 74, 76, additional cable types may be identified. Further, although the illustrative embodiment disclosed herein provides an appropriate matching impedance, other arrangements may provide different connections for different types of cable or for different adaptor connectors.

The invention described herein includes the advantages, among others, that it is simple and economical to implement, it automatically provides appropriate connections for different types of cable and connectors, and it allows a mixing of cable types at the user's discretion.

Accordingly, there has been disclosed an improved cable type identifying and impedance matching arrangement. While an illustrative embodiment of the present invention has been disclosed herein, it will be apparent to those of ordinary skill in the art that various modifications and adaptations to that embodiment are possible and it is only intended that the present invention be limited by the scope of the appended claims.

We claim:

1. An arrangement for providing connections to a cable wherein the cable includes a first plurality of individual wires and the cable is classified as one of a distinct number of cable types, all of the cable types including the same predetermined first plurality of individual wires, with each of the cable types having a distinct electrical characteristic, the arrangement including:

a) cable termination structure including:

1) means for holding an end of a cable (32; 62);

2) a second plurality of contact members arranged in a fixed position array, said second plurality of contact members including a first group (40, 42, 48, 50; 70, 72, 78, 80) each corresponding to a respective one of said first plurality of individual wires and a second group (36, 38, 44, 46; 66, 68, 74, 76);

3) means (52, 54, 56, 58; 82, 84, 86, 88) for connecting the individual wires of a cable held by said holding means each to a respective contact member of said first group; and 4) identifying means (90) for providing a predetermined set of connections between the contact members of said second group, the predetermined set of connections being unique for a particular cable type; and b) cable receiving structure including:

1) receptacle means (100) for receiving said contact members and providing electrical connections thereto;

2) means (176, 178, 170, 172) for detecting the connections between said second group of contact members and providing an identification signal corresponding to the particular cable type attached to said cable termination structure; and 3) means (174, 138) utilizing said identification signal for providing appropriate connections to said first group of contact members.

2. The arrangement according to claim 1 wherein there are two cable types and the electrical characteristic is characteristic impedance, said second group of contact members consists of a first contact member (36; 66) and a second contact member(38; 68), said identifying means includes means (90) for connecting said first contact member to said second contact member for a first type of cable and said utilizing means includes means (140, 146, 154, 160) for providing an appropriate matching impedance for the connections to said first group of contact members.

3. The arrangement according to claim 2 wherein said detecting means includes:

means (102) for providing a voltage through a resistor to said first contact member;

means (104) for applying ground to said second contact member; and means (170, 172) connected to said first contact member for generating said identification signal.

4. The arrangement according to claim 5 wherein said utilizing means includes:

a transformer winding (120, 122, 126, 128) having first and second ends and an intermediate tap;

a relay having a coil (138), a first contact (150, 144, 164, 158) connected to said transformer winding first end, a second contact (148, 142, 162, 156) connected to said transformer winding intermediate tap, and a movable armature (146, 140, 160, 154) normally in contact with one of said first and second relay contacts and movable upon energization of said relay coil to be in contact with the other of said first and second relay contacts; and means (174) responsive to said identification signal for selectively energizing said relay coil.

* * * * *